US006244832B1

(12) United States Patent
Guentert et al.

(10) Patent No.: US 6,244,832 B1
(45) Date of Patent: Jun. 12, 2001

(54) RADIAL PISTON PUMP FOR HIGH-PRESSURE FUEL DELIVERY

(75) Inventors: Josef Guentert, Gerlingen; Hans-Juergen Simon, Bad Liebenzell; Bernd Streicher, Filderstadt, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/288,817

(22) Filed: Apr. 9, 1999

(30) Foreign Application Priority Data

Apr. 9, 1998 (DE) ..... 198 16 044

(51) Int. Cl.[7] ..... F04B 1/12; F04B 1/04
(52) U.S. Cl. ..... 417/269; 417/273
(58) Field of Search ..... 417/269, 273; 92/72

(56) References Cited

U.S. PATENT DOCUMENTS

| | | | | |
|---|---|---|---|---|
| 2,271,570 | * | 2/1942 | Pardee | 103/174 |
| 2,621,607 | * | 12/1952 | Trapp | 103/174 |
| 3,092,037 | * | 6/1963 | Rhodes | 103/174 |
| 3,604,402 | * | 9/1971 | Hatz | 123/56 C |
| 4,223,595 | * | 9/1980 | Ortelli | 92/72 |
| 4,264,283 | * | 4/1981 | Gaffney | 417/269 |
| 4,673,337 | * | 6/1987 | Miller | 417/273 |
| 4,983,100 | * | 1/1991 | Budecker | 417/271 |
| 5,382,140 | * | 1/1995 | Eisenbacher et al. | 417/273 |

OTHER PUBLICATIONS

Mark's Standard Handbook for Mechanical Engineers, McGraw–Hill, p. 8–133, Dec. 1996.*

* cited by examiner

*Primary Examiner*—Charles G. Freay
*Assistant Examiner*—Timothy P. Solak
(74) *Attorney, Agent, or Firm*—Ronald E. Greigg; Edwin E. Greigg

(57) ABSTRACT

The invention relates to a radial piston pump for high-pressure fuel delivery in fuel injection systems of internal combustion engines, in particular in a common rail injection system, having a housing, a drive shaft that is supported in the pump housing and has an eccentrically embodied shaft segment. A ring is slidingly supported on the shaft segment and cooperates with a plurality of pistons. The pistons are disposed radially with respect to the drive shaft in a respective cylinder chamber. Ends of the pistons oriented toward the drive shaft each have a respective plate. To improve engine efficiency, the cylinder chambers are filled with less fuel as the demand drops, this prevents increased wear and damage from occurring during operation. The problem of wear and damage is solved in that all the plates are kept in contact with the ring by a leaf-spring-like device, in particular a single clamp. In a radial piston pump in which a plate is held by a plate holder, the plate holder is secured to the ring.

4 Claims, 5 Drawing Sheets

RADIAL PISTON PUMP FOR HIGH-PRESSURE FUEL DELIVERY

BACKGROUND OF THE INVENTION

The invention relates to a radial piston pump for high-pressure fuel delivery in fuel injection systems of internal combustion engines, in particular in a common rail injection system. A drive shaft that is supported in a pump housing and has an eccentrically embodied shaft segment, on which a ring is slidingly supported that cooperates with preferably a plurality of pistons, which are disposed radially with respect to the drive shaft in a respective cylinder chamber and whose ends oriented toward the drive shaft each have a respective plate.

In this kind of radial piston pump, which is braced on the inside, the plates mounted on the pistons have contact with the ring supported on the drive shaft. Because of the eccentricity of the drive shaft, the pistons are set in succession into a reciprocating motion. The stroke of the pistons is then constant and amounts to twice the eccentricity of the drive shaft.

To improve engine efficiency, it has been proposed that the cylinder chambers be filled with less fuel as the demand drops. In this so-called partial element filling, the components of the radial piston pump are subjected to extreme stress, and both increased wear and damage can occur.

OBJECT AND SUMMARY OF THE INVENTION

It is therefore an object of the invention to enable partial filling of the cylinder chambers of the radial piston pump. In particular, the radial piston pump of the invention should withstand a pumping pressure of up to 2000 bar in the pumping direction, and economical production should be possible.

In a radial piston pump for high-pressure fuel delivery in fuel injection systems of internal combustion engines, in particular in a common rail injection system, having a drive shaft that is supported in a pump housing and has an eccentrically embodied shaft segment, on which a ring is slidingly supported that cooperates with preferably a plurality of pistons. The pistons are disposed radially with respect to the drive shaft in a respective cylinder chamber and whose ends oriented toward the drive shaft each have a respective plate, this object is attained in that all the plates are kept in contact with the ring by a leaf-spring-like device, in particular a single clamp. In conventional radial piston pumps, the intake stroke motion of the piston is attained by a spring, which keeps the plate in contact against the ring. In the context of the present invention, it has been found that the high stresses in conventional radial piston pumps can be ascribed to twisting and tilting of the ring about its own axis. This twisting and tilting is in turn ascribed to the fact that in partial element filling, not all the plates rests permanently on the ring. The leaf-spring-like device assures the intake stroke motion of the pistons, even in a zero-pumping state. It is thus assured that all the plates will contact the ring even when the cylinder chambers are only partly filled with fuel, or are not filled at all. Twisting or tilting of the ring is avoided.

The embodiment according to the invention furthermore offers the advantage that the springs used in conventional radial piston pumps can be dispensed with. In other words, the space needed for the springs in a conventional pump housing is not needed. The machining openings in the pump housing that have to be made to create these spaces, and the associated sealing points, can thus be omitted as well. The pump housing becomes more compact, and its performance is less critical with respect to machining or to a heat treatment. Another advantage is that automatic assembly is made possible.

A particular variant embodiment of the invention is characterized in that the leaf-spring-like device is secured to the ring. This assures that the leaf-spring-like device executes the same motion as the ring. Fastening of the leaf-spring-like device to the ring can be done by an either non positive or positive connection.

Another particular variant embodiment of the invention is characterized in that the leaf-spring-like device is formed by a spring band, which extends in the circumferential direction around the ring and in which one oblong slot for each piston is disposed. The spring band is an economical starting material for the leaf-spring-like device of the invention. One oblong slot each assures that the ring can be displaced, together with the leaf-spring-like device, crosswise to the pistons. In the region of the oblong slots, the contour of the leaf-spring-like device is embodied as a leaf spring, in order to assure the prestressing to the pistons.

Another particular variant embodiment of the invention is characterized in that the leaf-spring-like device includes a plurality of spring wires, which extend in the circumferential direction around the ring. The use of the spring wires offers the advantage that the oblong slots in the variant embodiment described above can be dispensed with. This reduces the cost of producing the leaf-spring-like device of the invention.

Another particular variant embodiment of the invention is characterized in that the leaf-spring-like device is open on one side. The unilateral opening of the leaf-spring-like device can extend either over the entire length of the oblong slot or only in the region of the piston. The assembly of the leaf-spring-like device is made simpler by the unilateral opening.

Another particular variant embodiment of the invention is characterized in that the plate is secured to the piston by a plate holder. This has the advantage that parts of conventional pumps can be used in producing a radial piston pump according to the invention.

Another particular variant embodiment of the invention is characterized in that the plate is rigidly joined to the piston. This has the advantage of preventing twisting and/or tilting of the ring even more effectively than if the plate were movable.

The present invention also relates to a radial piston pump for high-pressure fuel delivery in fuel injection systems of internal combustion engines, in particular in a common rail injection system, having a drive shaft that is supported in a pump housing and has an eccentrically embodied shaft segment, on which a ring is slidingly supported that cooperates with preferably a plurality of pistons. The pistons are disposed radially with respect to the drive shaft in a respective cylinder chamber and whose ends oriented toward the drive shaft each have a respective plate held by a respective plate holder. In such a radial piston pump, the object described above is attained in that the plate holder is secured to the ring. This means that besides its original function, the plate holder also keeps the associated piston in contact with the ring, especially while fuel is being aspirated.

Another particular variant embodiment of the invention is characterized in that the plate holder has at least opposed two claws, whose ends facing one another firmly hold the plate, and at least two opposed claws, whose ends facing one another engage corresponding recesses in the ring. This has the advantage that only the plate holder and the ring need be embodied according to the present invention, in order to gain the advantages described above. For the rest of the pump, recourse can be had to parts for a conventional radial piston pump.

Another particular variant embodiment of the invention is characterized in that one flat face for each piston is provided on the ring. The polygonal design of the ring has the advantage that the course of motion is optimized. However, if a polygonal ring is used, the tilting of the ring about its own axis as described has a disadvantageous effect. The present invention therefore has special significance. By means of the embodiment according to the invention, the motion of the polygonal ring is effectively stabilized even during partial filling of an element.

The invention will be better understood and further objects and advantages thereof will become more apparent from the ensuing detailed description of a preferred embodiment taken in conjunction with the drawings. The characteristics recited in the specification may be essential to the invention either individually or in combination with one another.

DESCRIPTION OF THE PREFERRED EMBODIMENT

Figure 1:
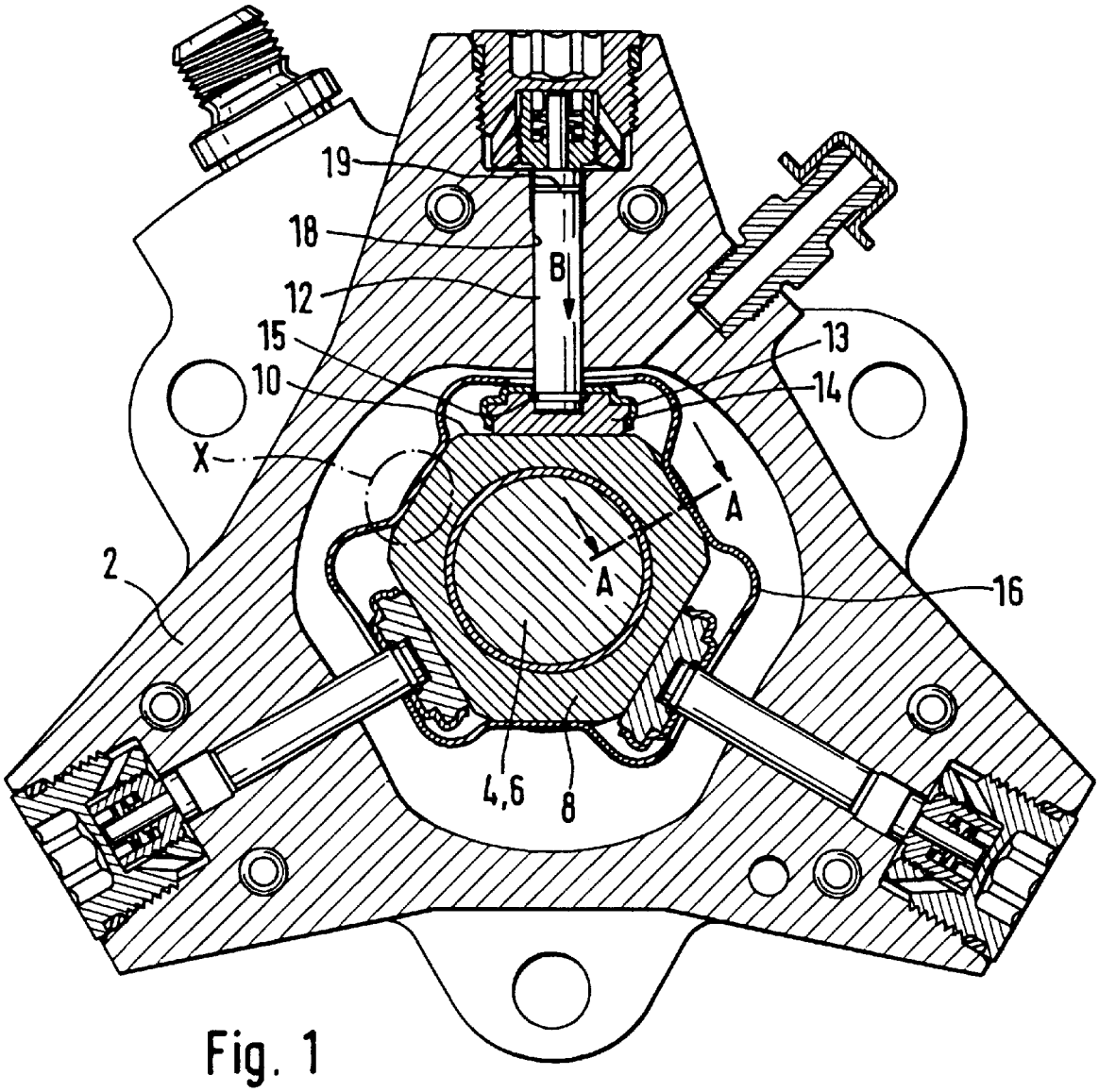
FIG. 1 is a section taken crosswise to the drive shaft of a first embodiment of a radial piston pump of the invention.

The radial piston pump shown in section in FIG. 1 is used especially in common rail injection systems for delivering fuel to Diesel engines. The term "common rail" means the same as "common line" or "common distributor strip". In contrast to conventional high-pressure injection systems, in which the fuel is pumped via a separate line to the individual combustion chambers, in common rail injection systems the injection nozzles are supplied from a common line. The radial piston pump shown is equipped with an integrated demand regulator. Fuel delivery and dimensioning are done via a metering unit, not shown.

The radial piston pump shown in FIG. 1 includes a drive shaft 4, which is supported in a pump housing 2 and has an eccentrically embodied shaft segment 6. On the eccentrically embodied shaft segment 6, a ring 8 is provided, relative to which the shaft segment 6 is rotatable. The ring 8 includes three flat faces 10, offset by 60° from each other, against each of which one piston 12 is braced. The pistons 12 are received in an element bore 18 such that they can reciprocate radially to the drive shaft 4, and each piston defines one cylinder chamber 19.

A plate 14 is attached by means of a plate holder 13 to the base of each piston 12 and rests on the associated flat face 10 of the ring 8. The plate holder 13 is secured to the piston 12 by a snap ring 15. The radial piston pump shown in FIG. 1 serves to impose high pressure on fuel that is furnished from a tank by a prefeed pump. The fuel, subjected to high pressure, is then pumped into the aforementioned common line. In the pumping stroke the pistons 12 are moved away from the axis of the drive shaft 4 by the eccentric motion of the ring 8. In the intake stroke, the pistons move radially toward the axis of the drive shaft, in order to aspirate fuel into the cylinder chambers 19.

Figure 3:
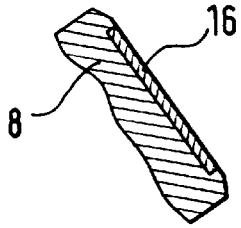
FIG. 3 is a section taken along the line A—A of FIG. 1.

The intake stroke motion of the pistons 12 is assured by means of a leaf-spring-like device or clamp, identified overall by reference numeral 16. The clamp 16 is formed, as shown in FIG. 3, of a spring band, which extends in the circumferential direction around the polygonal ring 8. The clamp 16 may take various shapes. One essential characteristic of the clamp 16 is that the clamp 16 rests on the surface of the plate holder 13 remote from the ring 8. This assures that the plate 14 will rest on the flat face 10 of the ring 8.

Figure 2:
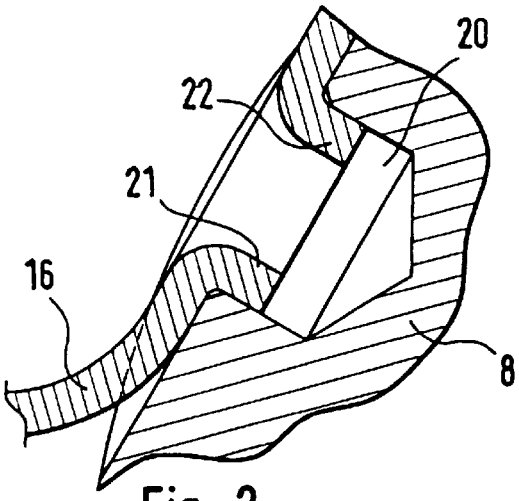
FIG. 2 is an enlarged view of detail X in FIG. 1.

In FIG. 2, an example can be seen of how the clamp 16 can be secured to the ring 8. A bore 20 is provided in the ring 8. A plurality of claws 21, 22 engage the bore 20 and prevent the clamp 16 from slipping on the ring 8. It is understood that the clamp can also be secured by means of a screw connection or some other positive or non positive connection.

Figure 4:
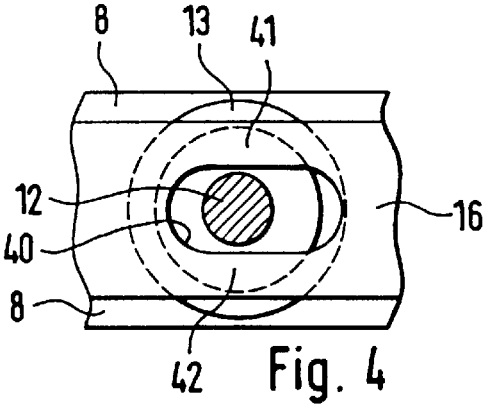
FIG. 4 is a section through one of the pistons in FIG. 1, taken in the direction indicated by the arrow B.

FIG. 4 shows that the clamp 16 is equipped with an oblong slot 40, through which the piston 12 extends. The oblong slot 40 assures that the ring 8 along with the clamp 16 can be shifted radially relative to the piston 12, while an axial displacement is prevented. The clamp 16 rests with leaf-spring-like regions 41, 42 on the plate holder 13 and assures that the motion of the ring longitudinally of the piston 12 is transmitted both to the plate and to the piston 12. The spring rigidity of the clamp 16 is selected such that even in the event of partial element filling, the plate 14 rests flush against the flat face 10 of the ring 8.

Figure 5:
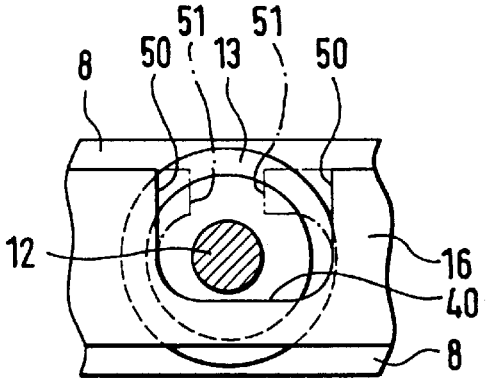
FIG. 5 is a view corresponding to FIG. 4 of a further embodiment of the invention.

It can be seen in FIG. 5 that the clamp 16 is equipped with a recess 50 in the region of the piston 12. The recess 50 extends over the entire length of the oblong slot 40 and facilitates the mounting of the clamp 16. In this process, the clamp 16 can simply be moved past the piston 12 until the edge of the oblong slot 40 opposite the recess rests on the piston 12. As the dashed lines suggest, however, the recess may also extend over only the region of the piston 12.

Figure 6:
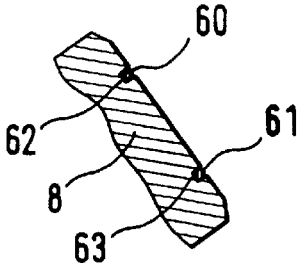
FIG. 6 is a view corresponding to FIG. 3 of a further embodiment of the invention.
Figure 7:
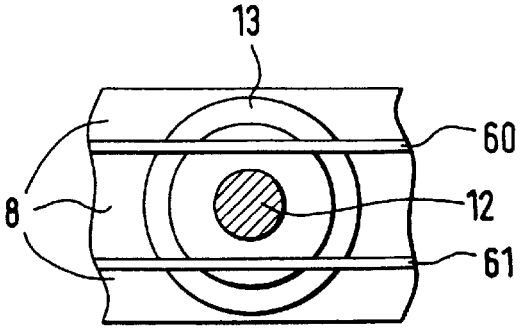
FIG. 7 is a view corresponding to FIGS. 4 and 5 of the embodiment of the invention shown in FIG. 6.

In FIGS. 6 and 7 it is shown that the clamp 16 can also be formed by two spring wires 60 and 61. The spring wires 60 and 61 then, like the spring band (16 in FIG. 3), rest partly on the plate holder 13-and partly on the ring 8. To prevent slippage of the spring wires 60, 61, these wires are guided in corresponding grooves 62, 63, which are made in the ring 8.

Figure 8:
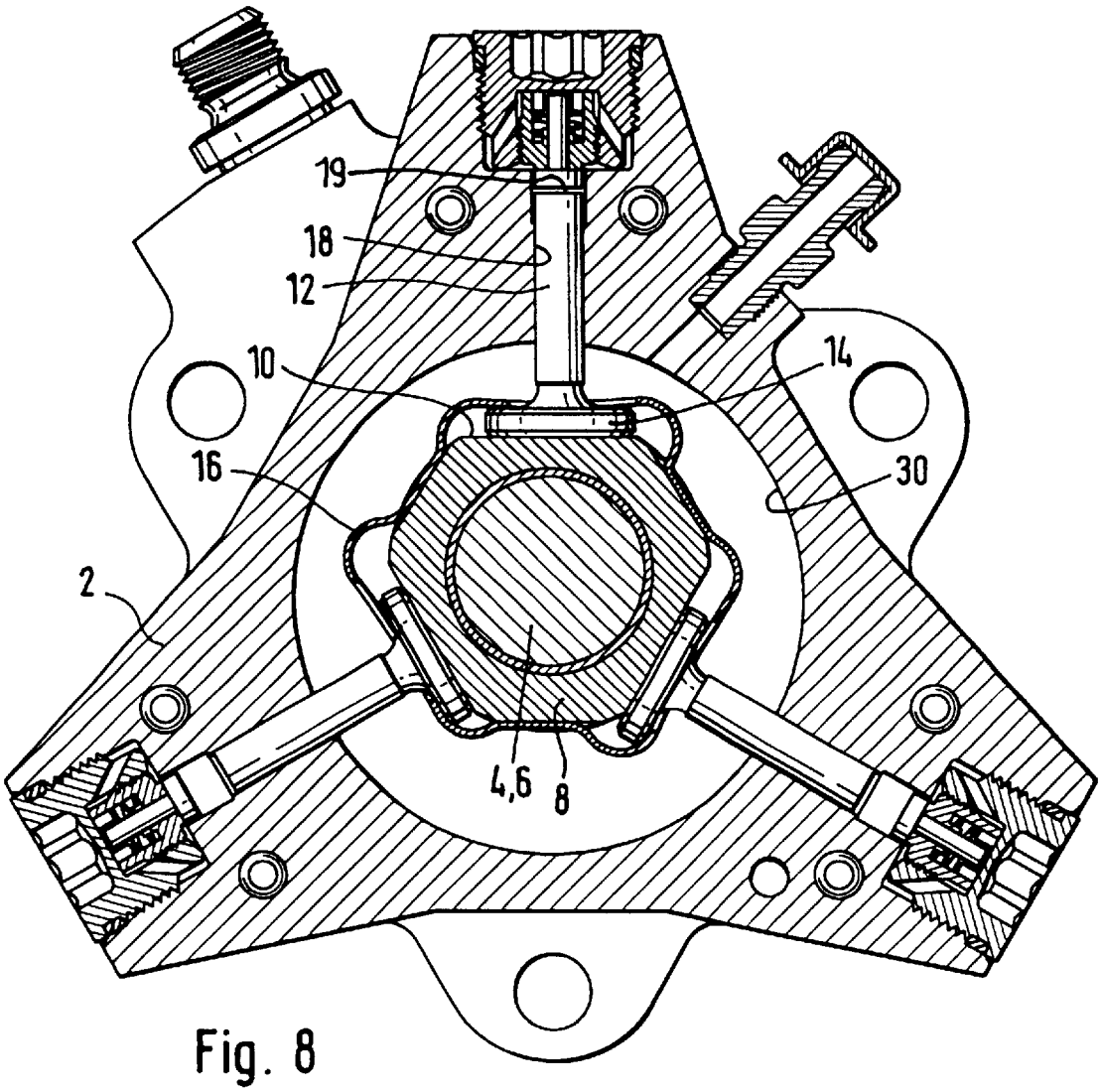
FIG. 8 is a view corresponding to FIG. 1 of a further embodiment of the invention.

The radial piston pump shown in FIG. 8 is extensively equivalent to the embodiment shown in FIG. 1. To avoid repetition, a detailed description will therefore be dispensed with. For the sake of simplicity, identical parts are identified by the same reference numerals. The primary difference between the two embodiments is that in FIG. 8, the pistons 12 are each integral with the associated plates 14. This increases the strength of the component, which contributes to stabilizing the motion of the ring 8. Furthermore, the interior 30 of the pump housing 2 is simply hollowed out. This makes the radial piston pump simpler to produce.

In FIGS. 9–12. a further embodiment of a radial piston pump of the invention is shown. However, only those parts of the radial piston pump that are important to this embodiment are shown.

Figure 9:
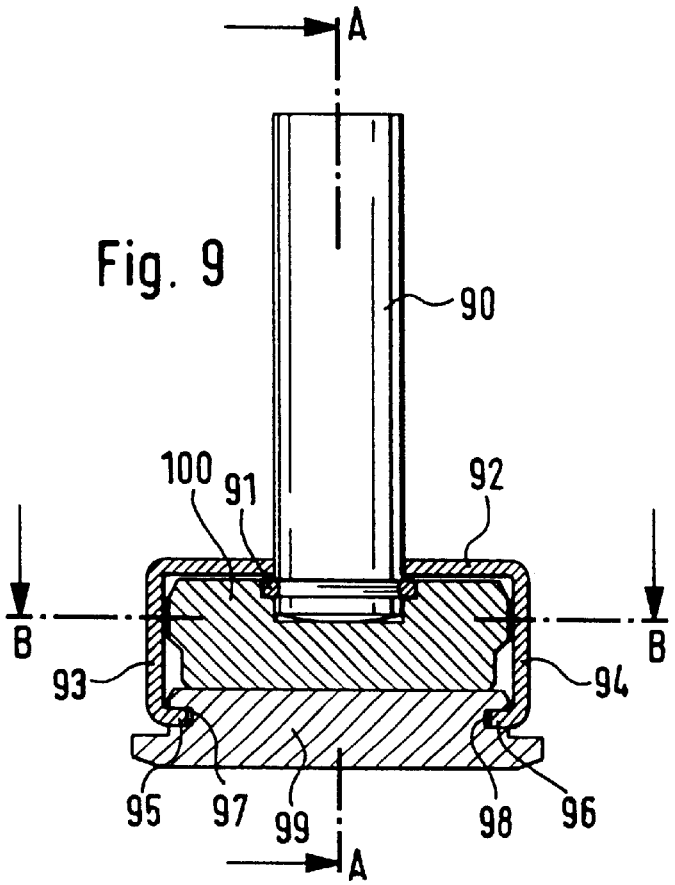
FIG. 9 shows a sectional view of a further embodiment of the invention.
Figure 12:
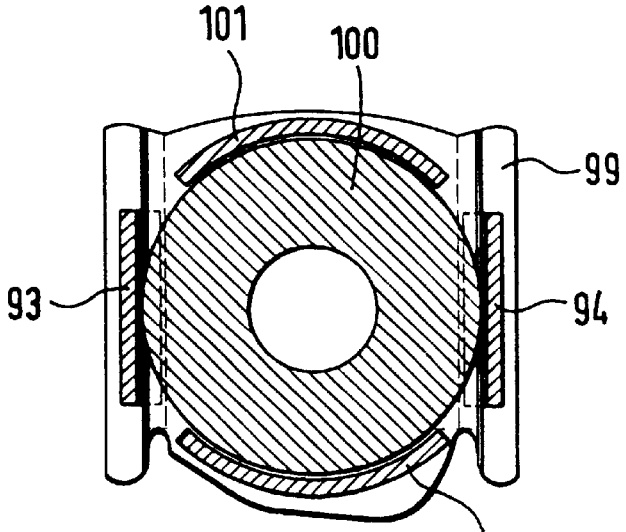
FIG. 12 is a section taken along the line B—B of FIG. 9.

In the sectional view shown in FIG. 9, a piston 90 is shown on which a plate holder 92 is held with the aid of a snap ring 91. The plate holder 92 has a plurality of claws 93, 94, whose ends 95, 96 are bent inward. The inward-bent ends 95, 96 of the plate holder 92 engage grooves 97, 98, which are provided on the face ends of a ring 99. The plate holder 92 serves to keep a plate 100 in contact with a flat surface 109 of the ring 99.

Figure 10:
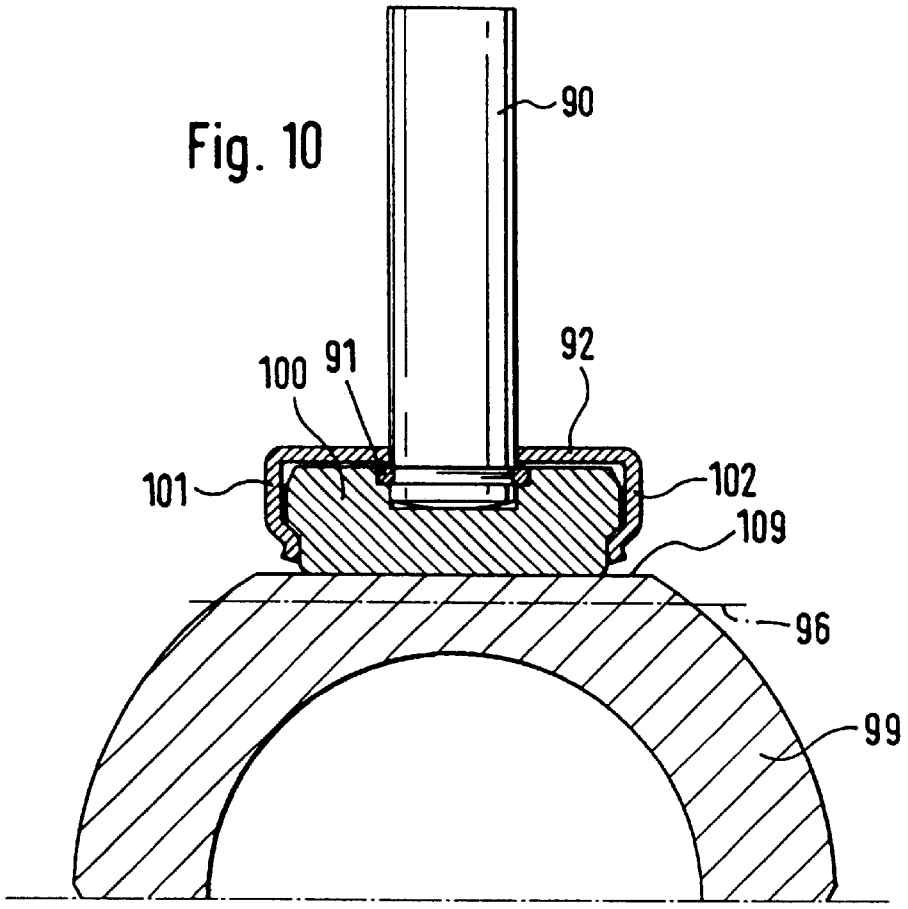
FIG. 10 is a section taken along the line A—A of FIG. 9.

It can be seen in FIG. 10 that in addition to the claws 93, 94, the plate holder 92 also has a further two claws 101, 102. The claws 101, 102 serve to keep the plate 100 on the piston 90.

Figure 11:
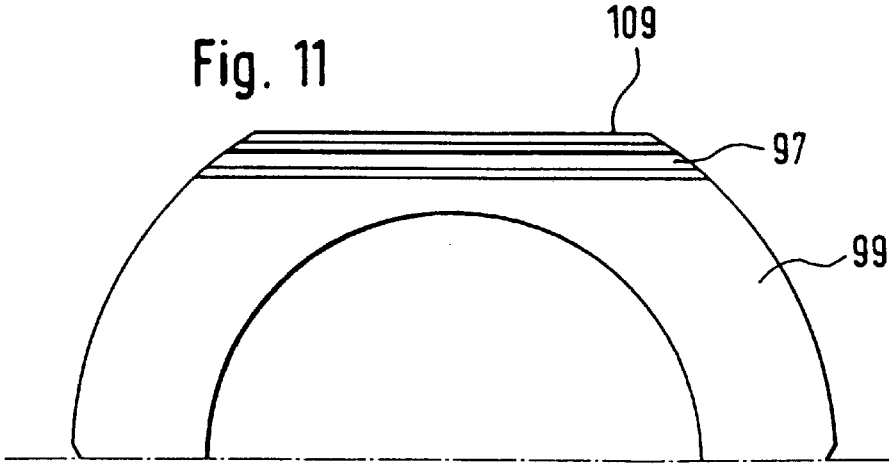
FIG. 11 is a plan view on the ring shown in section in FIG. 10.

The course of the groove 97 in the ring 99 can be best seen in FIG. 11. The course shown allows the ring 99 to be displaced longitudinally of the groove 97 when the ring 99 executes the eccentric motion described above.

As shown in the sectional view of FIG. 2, the plate holder 92 includes one pair of claws 93, 94, and one pair of claws 101, 102. Instead of these two pairs of claws, it is naturally also possible for there to be three, four or more pairs of claws on the plate holder 92.

The foregoing relates to preferred exemplary embodiments of the invention, it being understood that other variants and embodiments thereof are possible within the spirit and scope of the invention, the latter being defined by the appended claims.

We claim:

1. A radial piston pump for high-pressure fuel delivery in fuel injection systems of internal combustion engines, comprising a pump housing, a drive shaft that is supported in the pump housing, said drive shaft includes an eccentrically embodied shaft segment, a ring (99) that cooperates with a plurality of pistons (90) is slidingly supported on said shaft segment, said pistons are disposed radially with respect to the drive shaft in a respective cylinder chamber, said pistons include ends oriented toward the drive shaft, a respective plate (100) is held by a respective plate holder (92), the plate holder (92) is secured to the ring (99), and the plate holder (92) has first and second opposed claws (101, 102), whose ends facing one another firmly hold the plate (100), and third and fourth opposed claws (93, 94), whose ends (95, 96) facing one another engage corresponding recesses (97, 98) in the ring (99).

2. The radial piston pump according to claim 1, in which one flat face (10, 109) for each piston is provided on the ring (8, 99).

3. The radial piston pump according to claim 1, in which the plate is secured to the piston by a plate holder.

4. The radial piston pump according to claim 1, in which the plate is rigidly joined to the piston.

* * * * *